US009228398B2

(12) United States Patent
Behrens

(10) Patent No.: US 9,228,398 B2
(45) Date of Patent: Jan. 5, 2016

(54) TELESCOPING RISER SKID

(71) Applicant: PREMIER COIL SOLUTIONS, INC., Houston, TX (US)

(72) Inventor: Randall D. Behrens, Houston, TX (US)

(73) Assignee: Premier Coil Solutions, Inc., Houston, TX (US)

( * ) Notice: Subject to any disclaimer, the term of this patent is extended or adjusted under 35 U.S.C. 154(b) by 191 days.

(21) Appl. No.: 14/086,863

(22) Filed: Nov. 21, 2013

(65) Prior Publication Data

US 2014/0158651 A1 Jun. 12, 2014

Related U.S. Application Data

(60) Provisional application No. 61/729,076, filed on Nov. 21, 2012.

(51) Int. Cl.
*E21B 19/14* (2006.01)

(52) U.S. Cl.
CPC ..... *E21B 19/14* (2013.01)

(58) Field of Classification Search
CPC ..... E21B 19/14
USPC ..... 206/303, 443, 391; 211/70.4, 60.1, 207, 211/208, 175
See application file for complete search history.

(56) References Cited

U.S. PATENT DOCUMENTS

| | | | | |
|---|---|---|---|---|
| 3,913,753 | A * | 10/1975 | Swartz | E21B 19/146 175/52 |
| 4,455,116 | A * | 6/1984 | Lindstedt | E21B 19/146 175/52 |
| 6,450,330 | B1 * | 9/2002 | Cannata | E21B 19/14 206/303 |
| 6,951,283 | B2 * | 10/2005 | Savoie | B65D 43/24 206/443 |
| 7,328,804 | B2 * | 2/2008 | Andre | B65D 19/12 206/386 |
| 7,484,620 | B2 * | 2/2009 | Miller | B25H 3/003 206/379 |
| 8,210,374 | B2 * | 7/2012 | Harpole | B65D 19/12 211/194 |
| 8,657,130 | B2 * | 2/2014 | Thrush | A47F 5/08 211/117 |
| 2007/0007223 | A1 * | 1/2007 | Thrush | A47B 96/14 211/118 |

* cited by examiner

*Primary Examiner* — Steven A. Reynolds
*Assistant Examiner* — King M Chu
(74) *Attorney, Agent, or Firm* — Lloyd L. Davis; Andrews Kurth LLP

(57) ABSTRACT

A riser transport system includes telescoping vertical riser racks to facilitate vertical riser transport.

11 Claims, 7 Drawing Sheets

TELESCOPING RISER SKID

CROSS-REFERENCE TO RELATED APPLICATIONS

This application claims priority under 35 U.S.C. §119(e) to U.S. Provisional Patent Application Ser. No. 61/729,076, filed Nov. 21, 2012, incorporated herein by reference in its entirety.

FIELD

This disclosure relates in general to a blowout preventer and riser skid having telescoping vertical riser racks.

BACKGROUND

In the oil and gas industries, coiled tubing refers to metal piping, normally one inch to almost four inches in diameter, used for interventions in oil and gas wells and sometimes as production tubing in depleted gas wells, which comes spooled on a large reel. The main engine of a coiled tubing intervention is the injector head. This component contains the mechanism to push and pull the coiled tubing into and out of the hole. Below the injector is a stripper, which contains rubber pack-off elements providing a seal around the tubing to isolate the well's pressure. Below the stripper is the blowout preventer, which provides the ability to cut the coiled tubing pipe and seal the wellbore and hold and seal around the pipe. The BOP also sits below the riser, which provides the pressurized tunnel down to the top of the wellhead. Risers may be transported by roadway in different lengths. What is needed then is an apparatus to transport risers of varied or longer lengths.

DETAILED DESCRIPTION

Figure 1:
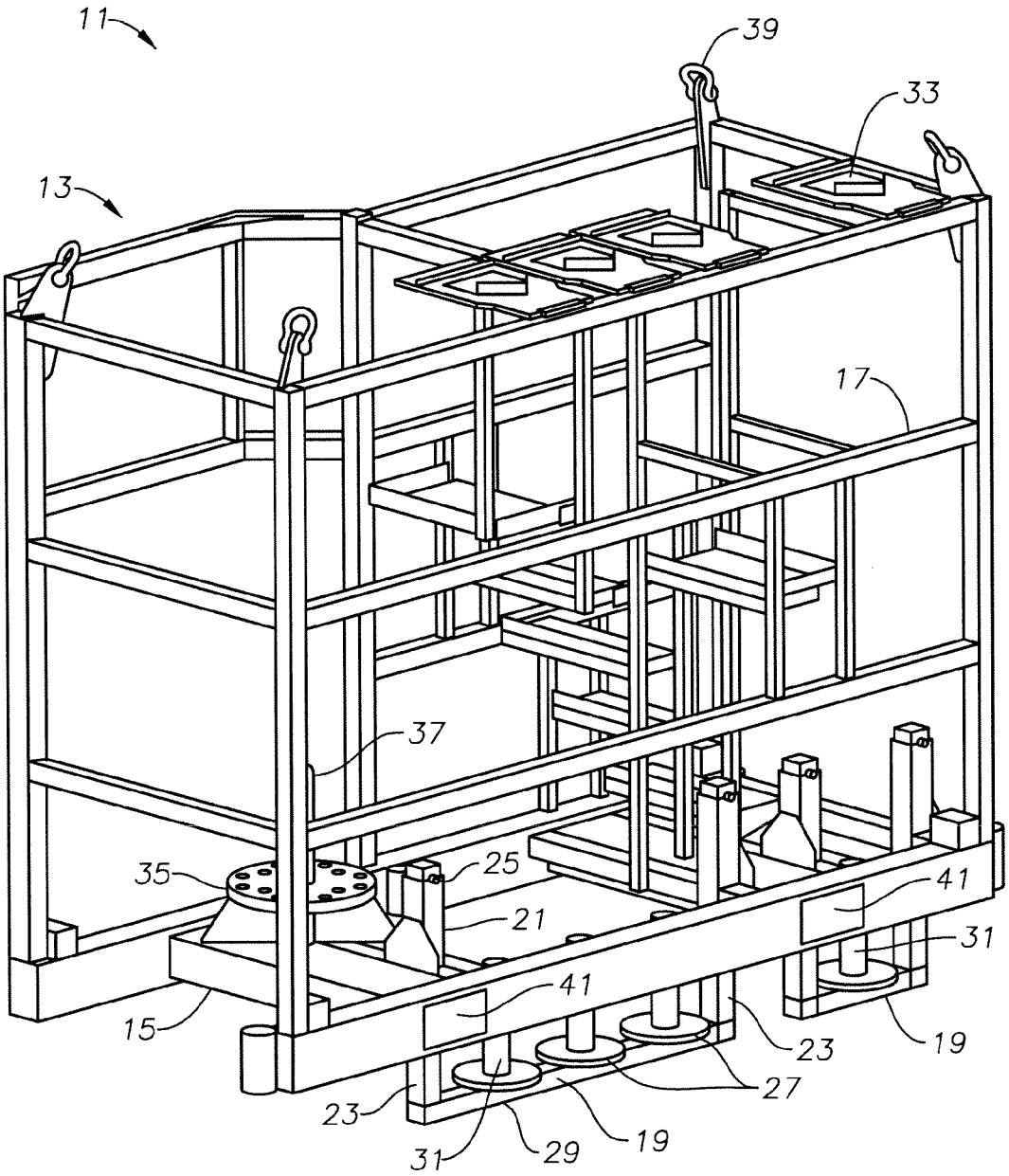
FIG. 1 is a perspective view illustrating a riser transport skid in accordance with this disclosure.

The aspects, features, and advantages of the invention mentioned above are described in more detail by reference to the drawings, wherein like reference numerals represent like elements.

Figure 2:
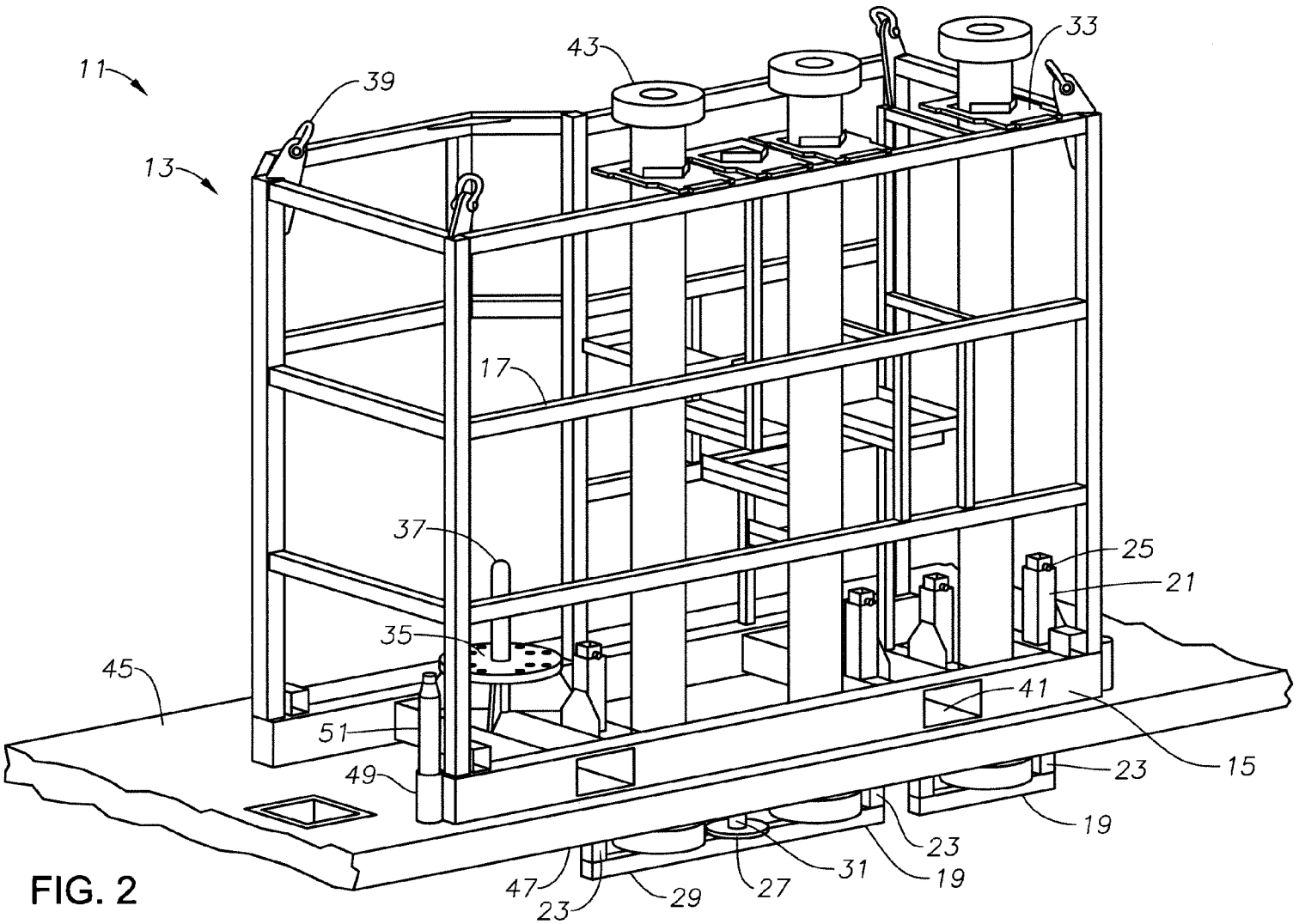
FIG. 2 is a perspective view illustrating the riser transport skid of FIG. 1 positioned on a unit with risers loaded in the transport position.

FIG. 1 illustrates a riser transport system 11 having telescoping vertical riser racks to facilitate vertical riser transport. The riser transport system 11 includes a riser transport skid 13 with a load supporting skid frame base 15. A skeletal riser support structure 17 extends upward from the load supporting skid frame base 15 and provides structural support for the skid 13 to hold risers 43 vertically (as shown in FIG. 2) in the riser transport system 11. In some embodiments a blowout preventer ("BOP") (not shown) may also be transported on the riser transport skid 13 and the skeletal riser support structure 17 can provide support to hold and transport the BOP vertically. One or more telescoping riser sections 19 are connected to and telescope downward from the load supporting skid frame base 15. Each riser section 19 can have one or more telescoping riser section guide sleeves 21 that attach to the load supporting skid frame base 15. In the preferred embodiment each riser section 19 has a pair of riser section guide sleeves 21 on each lengthwise end of each riser section 19. The guide sleeves 21 guide the movement of telescoping riser section support arms 23 which are housed within the guide sleeves 21, which are open at the top and bottom. When the riser transport system 11 is on a trailer and configured for transport, the telescoping riser section support arms 23 hang below the trailer section supporting the bottom of the skid 13 through a cutout in the trailer bed (FIG. 2). In the embodiment shown both the riser section guide sleeves 21 and the riser section support arms 23 are made with rectangular tubing. In an embodiment, circular tubing or other similar structures can form the guide sleeves 21 and support arms 23. The telescoping riser section support arms 23 each have at least one retaining pin 25 extending through the top of the riser section support arm 23. The retaining pins 25 prevent the arms 23 from sliding through the guide sleeves 21. Additionally, the retaining pin 25 bears at least some of the weight of the telescoping riser section 19 including the weight of the risers (FIG. 2) and any downhole tools transported inside the risers. One or more circular riser transport bases 27 connect to a telescoping riser section horizontal support beam 29. The circular riser transport bases 27 each have a central cylindrical riser mounting post 31 that inserts into the riser to keep the riser stabilized on the base 27. The support beam 29 connects to or between the one or more telescoping riser section support arms 23. The horizontal support beam 29 and the circular riser transport bases 27 both telescope with the support arms 23. At least one advantage of the riser transport system 11 and the ability of the system to extend the risers below the trailer deck is that height restriction requirements for highway overpasses and other similar height restrictive obstacles can be overcome. Thus the telescoping action of this section allows the risers to be transported completely vertically for easier and faster installation once on the drilling site. Traditionally risers are transported horizontally on separate trucks from the BOP or horizontally on the same trailer as the BOP. The ability to transport risers vertically allows for much faster install times and the ability to keep any riser contained tools in the installation position, among other benefits. Additionally, a set of collar like riser top end stabilizers 33 keep the top end of the risers in position during transport. The top end stabilizers 33 fold up and down to facilitate the loading and unloading of the risers and extend around the top end of the risers to prevent movement during transport. The stabilizers 33 connect to the upper frame of the skeletal riser support structure 17 and allow up and down movement of the riser while providing support.

In some embodiments the riser transport skid 13 can also transport a BOP. In these embodiments, such as that shown in FIG. 1, a BOP transport base 35 connects to the load supporting skid frame 15 and extends away from a BOP cylindrical mounting post 37 on the centerline of base 35. The BOP mounting post 37 supports the BOP in the vertical position such that the BOP is ready to install when it arrives on the installation site. The riser transport skid 13 can be transported to the installation site on a crane trailer or other trailer. A set of transport skid crane cable anchors 39 are attached to the top of the skeletal riser support structure 17 of the skid 13. The cable anchors 39 allow the crane to quickly attach to the skid 13 in order to move the skid 13 to a ground location at the installation site. As the skid 13 is lowered onto the ground, the telescoping riser sections 19 push against the ground causing the telescoping riser section support arms 23 to move upward through the telescoping riser section guide sleeves 21. Once on the ground the BOP and risers can be lifted by the crane to the installation location at the well site and installed.

FIG. 2 illustrates a perspective view of the riser transport skid 13 of FIG. 1 positioned on a unit in the transport position. In addition to loading and unloading the riser transport skid 13 on and off a unit using the transport skid crane cable anchors 39, a pair of skid integrated fork lift cavities 41 may be used where a crane is not available. In an embodiment, the skid integrated fork lift cavities 41 can extend through the load supporting skid frame. In an example, the skid 13 can be initially loaded on the transport unit 45 using a fork lift when it would be impractical to deploy a crane, such as in a warehouse. Risers 43 are shown loaded vertically in the transport skid 13 with the telescoping riser sections 19 fully extended. A cutout 47 in the transport unit 45 provides room for the telescoping riser sections 19. In an embodiment, the riser skid 13 can be fitted with riser transport skid positioning cuffs 49 attached to the exterior facing edges of the load supporting skid frame 15. The cuffs 49 are tubular members with open ends and can be lowered onto riser transport skid alignment posts 51, thereby positioning the riser transport skid 13 on the trailer unit 45. When lowered on fixed alignment posts 51, the cuffs 49 prevent the transport skid 13 from sliding during transport.

Figure 3:
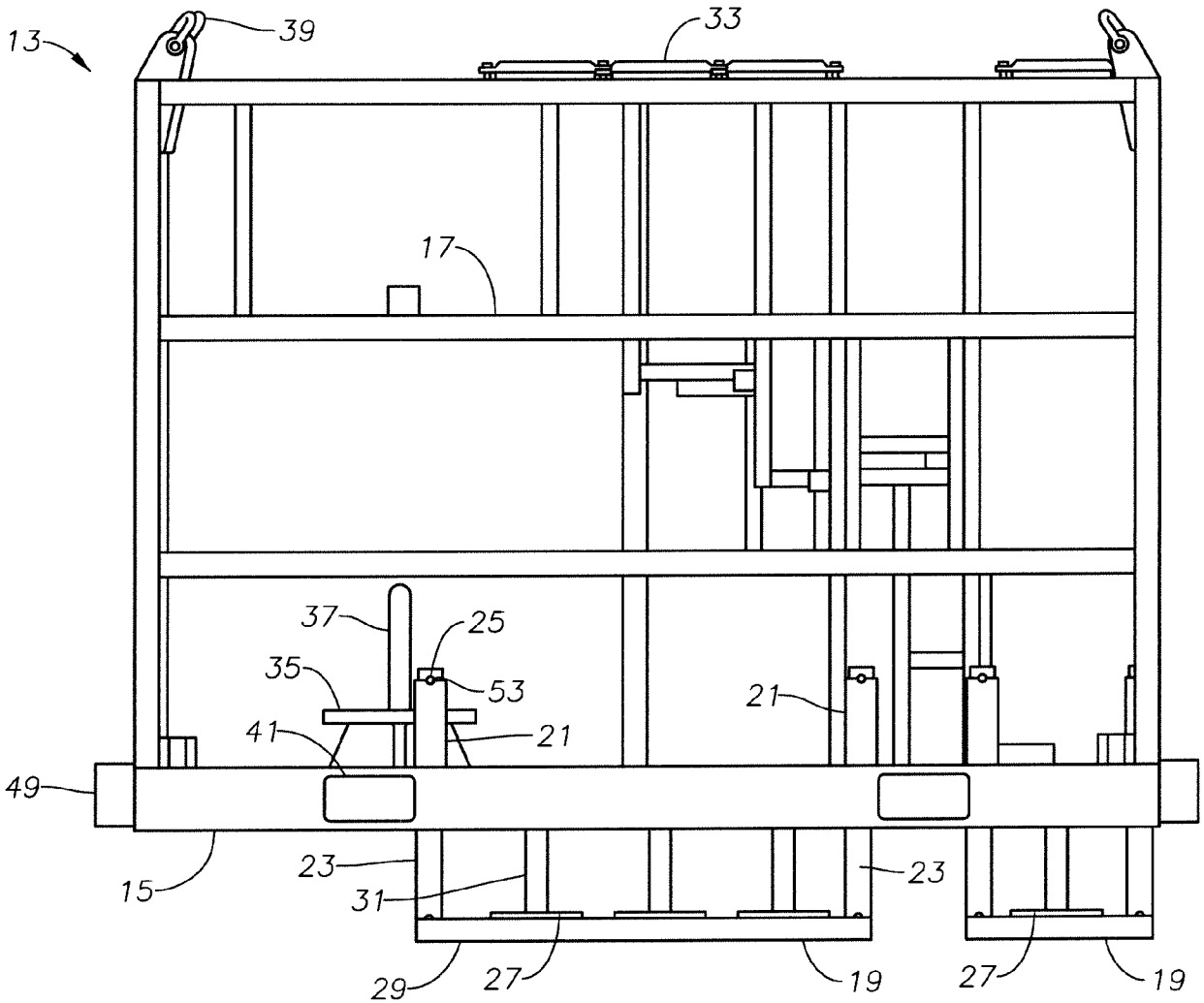
FIG. 3 is a left-side elevational view illustrating the riser transport skid of FIG. 1.
Figure 7:
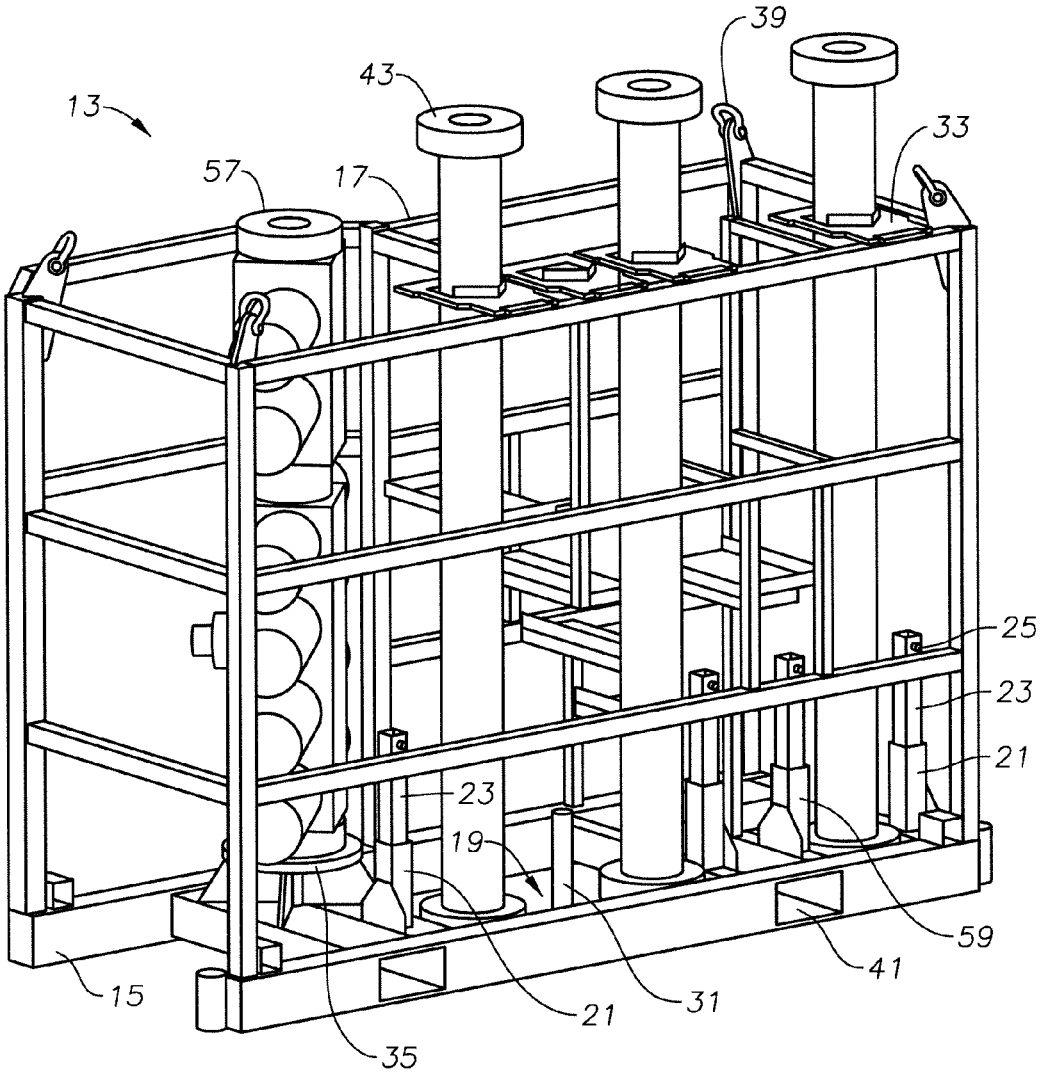
FIG. 7 is a perspective view illustrating the riser transport skid of FIG. 1 with the skid positioned on the ground.

FIG. 3 is a left-side elevational view illustrating the riser transport skid 13 of FIG. 1. In this view, the telescoping riser sections 19 are fully extended beneath the load supporting skid frame base 15. In some embodiments, the telescoping riser section retaining pins 25 can rest in a pin cutout groove 53 on the upper end of the telescoping riser section guide sleeves 21. The retaining pins 25 extend beyond the width of the guide sleeves 21 and rest on top of the guide sleeves to thereby retain the telescoping riser section 19. The pin cutout groove 53, being centrally located on the top end of the guide sleeves 21, helps centrally align the telescoping riser section support arms 23 within the telescoping riser section guide sleeves 21. Additionally, in some embodiments, the telescoping riser section support arms 23 may be greased to more easily slide within the telescoping riser section guide sleeves 21. In an embodiment the telescoping riser section guide sleeves 21 can each have one or more grease zerks 59 (as shown in FIG. 7) that allow the user to grease each sleeve so that the telescoping riser section 19 will raise and lower when removing the skid from the trailer without seizing up. The grease zerk 59 is similar to a nub or nozzle that allows grease to be shot through the sleeve 21 to the contact area between the internal sleeve walls and the external support arm 23 walls.

Figure 4:
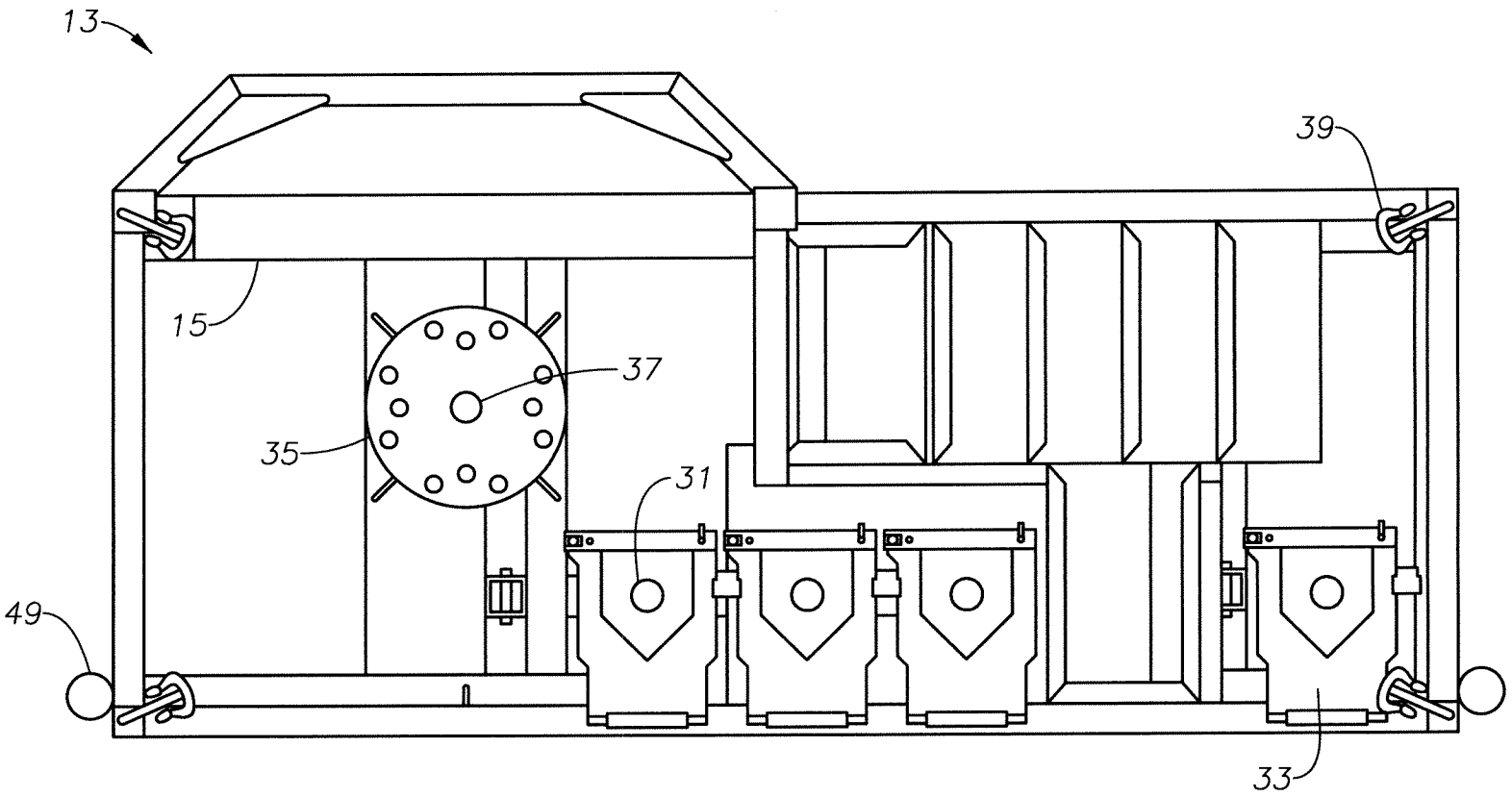
FIG. 4 is a top plan view illustrating the riser transport skid of FIG. 1.

FIG. 4 illustrates a top plan view of the riser transport skid 13 of FIG. 1. This view shows the central alignment of the cylindrical riser mounting posts 31 in relation to the collar like riser top end stabilizers 33. The stabilizers 33 extend around the risers on the top end of the skeletal support structure 17 thereby preventing side to side movement of the risers 43 during transport. Additionally, this view illustrates an embodiment where two riser transport skid positioning cuffs 49 are placed on opposite ends of the outer beam of the load supporting skid frame base 15. By placing the cuffs 49 only on the outer facing side of the trailer a fork lift operator or other personal can more easily see the cuffs when lowering the riser transport skid 13 onto a trailer unit (as shown in FIG. 2).

Figure 5:
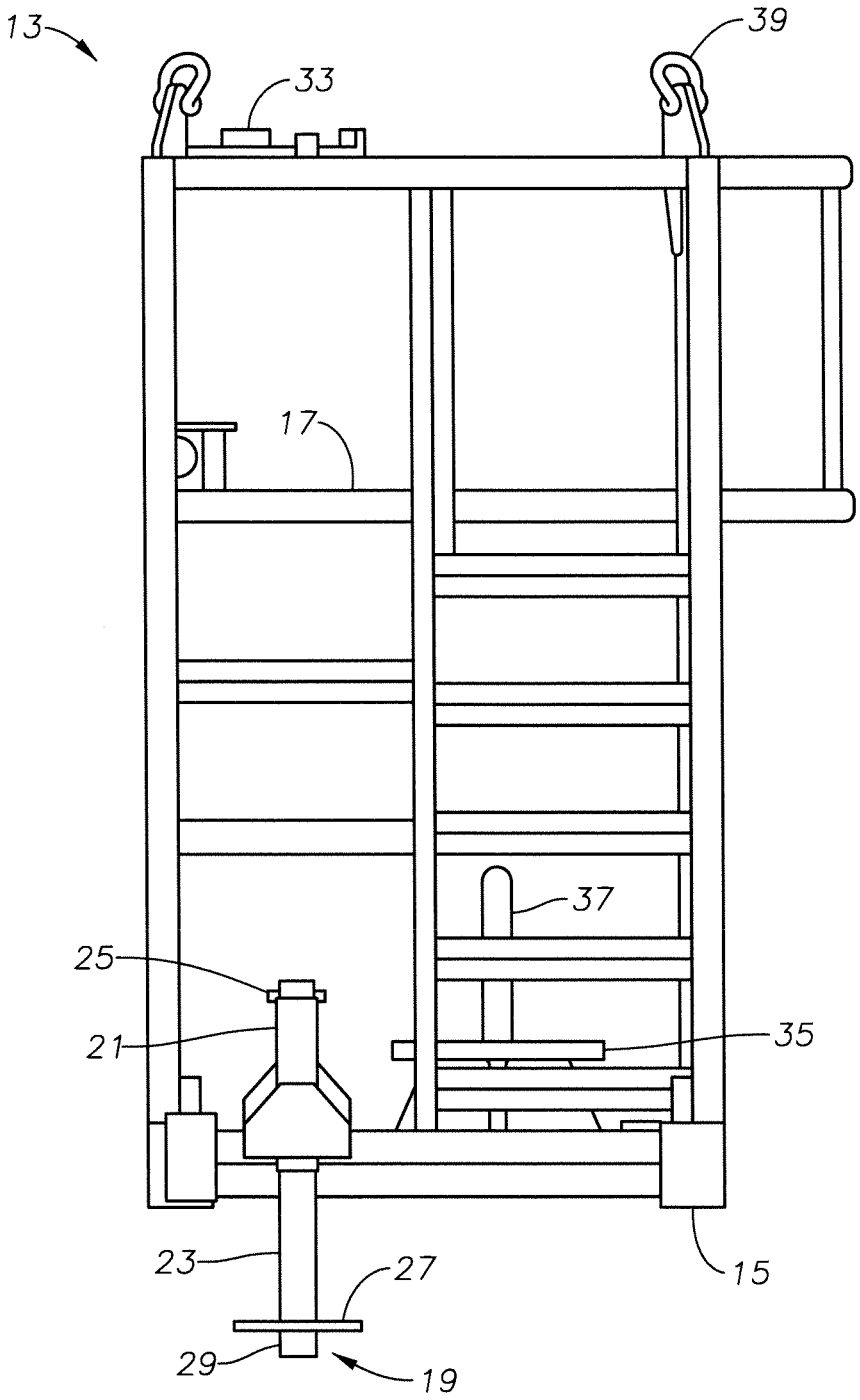
FIG. 5 is a back elevational view illustrating the riser transport skid of FIG. 1.

FIG. 5 illustrates a back elevational view of the riser transport skid of FIG. 1 where the telescoping riser sections 19 are hanging in the transport position. In an embodiment the width and thickness of the circular riser transport bases 27 can be increased to accommodate heavier riser or riser contained tool sections. Additionally, in some embodiments the riser transport skid 13 can have more or less telescoping riser sections 19 for differing installation setups. In the illustrated embodiment the risers are positioned on the rearward outer side of the trailer unit 45 and the BOP transport base 35 is positioned on the forward inner side of the trailer unit 45. In these positions the weight of the BOP and risers is balanced around the load supporting skid frame 15. In other embodiments, different positions of the riser transport sections 19 and the BOP transport base 35 can be used.

Figure 6:
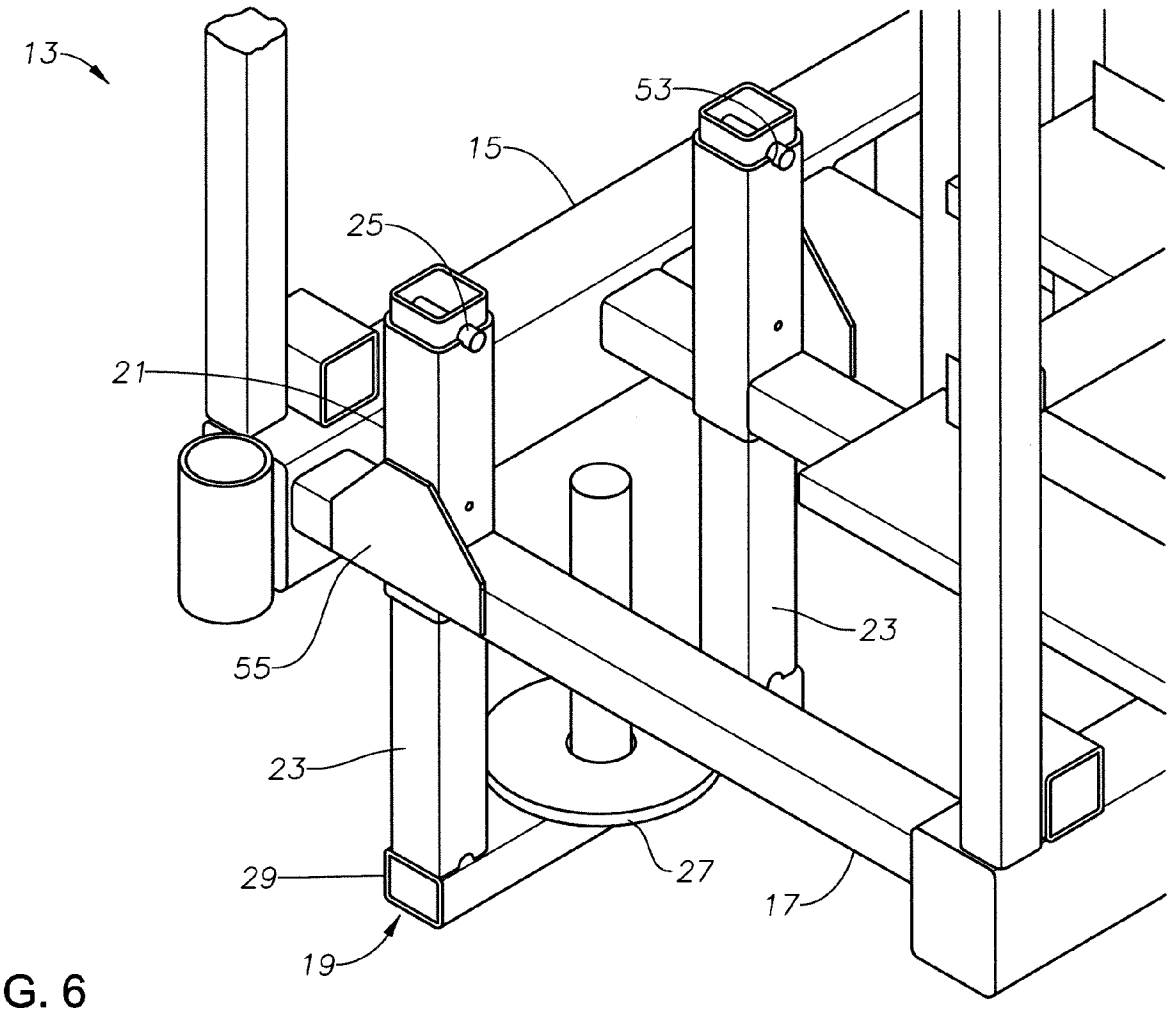
FIG. 6 is an alternate perspective view illustrating a telescoping riser section of the riser transport skid of FIG. 1.

FIG. 6 illustrates an enlarged view of one of the telescoping riser sections 19 of the riser transport skid 13 of FIG. 1. This view shows the retaining pins 25 passing through the telescoping riser section support arms 23 and resting in the pin cutout grooves 53. The telescoping riser section guide sleeves 21 can each be welded to a guide sleeve mounting plate 55 or connected by other means to the skid 13. Additionally, the guide sleeve mounting plates 55 can connect to the load supporting skid frame 15 or to other portions of the skeletal riser support structure 17.

FIG. 7 illustrates a perspective view of the riser transport skid of FIG. 1 with the skid 13 positioned on the ground, ready for the risers 43 to be installed. When the skid 13 was lowered onto the ground, the telescoping riser sections 29 were pushed against the ground and caused the telescoping riser section support arms 23 to move upward through the telescoping riser section guide sleeves 21, thereby spacing the retaining pins 25 away from the guide sleeves 21. Once on the ground the BOP 57 and risers 43 can be lifted by a crane directly from the skid 13 to an installation position at the well site. Shipping the risers 43 in this vertical position and the ability to remove the skid from the trailer unit 45 onto the ground and have the risers 43 in the ready-to-install position allows for much faster setup times at the well site.

The claimed subject matter is not to be limited in scope by the specific embodiments described herein. Indeed, various modifications of the invention in addition to those described herein will become apparent to those skilled in the art from the foregoing description. Such modifications are intended to fall within the scope of the appended claims.

The invention claimed is:

1. A riser transport system having telescoping components to facilitate vertical riser transportation, the system comprising:

a riser transport skid comprising:

a load supporting skid frame, a skeletal riser support structure, and one or more telescoping-riser-sections comprising:

one or more sets of telescoping-riser-section guide sleeves connected to a lower portion of the load supporting skid frame;

one or more sets of telescoping-riser-section support arms slide-able within the plurality of sets of telescoping-riser-section support sleeves;

a plurality of retaining pins each extending through one of the plurality of telescoping-riser-section support arms, to thereby support the telescoping-riser-section; and a plurality riser transport bases, each base connected to a horizontal support beam between each set of telescoping riser support arms and each base having a cylindrical riser mounting post to thereby maintain riser position during transport.

2. The riser transport system of claim 1, further comprising:

a plurality of collar-like riser top-end-stabilizers to maintain position of the plurality of risers during transport.

3. The riser transport system of claim 1, further comprising a blowout preventer transport base connected to the load supporting skid frame, and a blowout preventer mounting post extending away from said transport base.

4. The riser transport system of claim 1, further comprising a set of transport skid crane cable anchors attached to a top portion of said skeletal riser support structure.

5. The riser transport system of claim 1, further comprising a pair of skid integrated fork lift cavities configured to extend through the load supporting skid frame.

6. The riser transport system of claim 1, further comprising one or more hollow tubular members attached to exterior facing edges of the load supporting skid frame configured to engage one or more skid alignment posts on a transport unit.

7. The riser transport system of claim 1, wherein said telescoping-riser-sections are configured to extend downward into a cutout in a transport unit.

8. The riser transport system of claim 1, further comprising a pin cutout groove in an upper end of said telescoping-riser-section guide sleeves, wherein said retaining pins are configured to engage said pin cutout groove.

9. The riser transport system of claim 8, wherein said pin cutout groove is centrally located on the top of said guide sleeves and configured to centrally align said telescoping riser section support arms within said guide sleeves.

10. The riser transport system of claim 1, wherein said retaining pins extend beyond a width of said guide sleeves and rest on top of the guide sleeves to thereby retain said telescoping riser sections.

11. The riser transport system of claim 1, further comprising one or more grease zerks in said telescoping riser section guide sleeves configured to allow a user to grease each sleeve.

* * * * *